United States Patent [19]

Havemann

[11] 4,329,957

[45] May 18, 1982

[54] ENGINE CONTROL

[75] Inventor: Robert K. Havemann, Bloomington, Minn.

[73] Assignee: Thermo King Corporation, Minneapolis, Minn.

[21] Appl. No.: 197,379

[22] Filed: Oct. 15, 1980

[51] Int. Cl.[3] ..... F02D 35/02

[52] U.S. Cl. ..... 123/378; 60/906

[58] Field of Search ..... 123/378, 395, 396, 398, 123/401; 60/906

[56] References Cited

U.S. PATENT DOCUMENTS

| | | | |
|---|---|---|---|
| 2,197,743 | 4/1940 | Crafts et al. | 91/365 |
| 2,293,814 | 8/1942 | Garrett | 264/3 |
| 3,099,254 | 7/1963 | Kerr | 60/906 X |
| 3,523,742 | 8/1970 | Gold | 415/17 |
| 3,685,501 | 8/1972 | Honda | 123/378 |
| 4,117,740 | 10/1978 | Howland | 60/906 X |

*Primary Examiner*—William A. Cuchlinski, Jr.
*Attorney, Agent, or Firm*—E. C. Arenz

[57] ABSTRACT

An engine speed and loss of oil pressure control arrangement for an engine such as is used in transport refrigeration and is operative at a low speed and a high speed, the arrangement including two axially aligned pistons 12 and 36 into adjacent cylinders 10 and 34, respectively, the first piston 12 moving from an engine off position to a low speed position upon closure of the valve 22 when engine operation is initiated, this forcing the second piston 36 to a low speed position which effects said low speed through leakage 40 to the engine speed control means, the second piston 36 moving further to the right to an engine high speed position upon opening of valve 28 in a conduit leading from the first cylinder to the second cylinder.

6 Claims, 3 Drawing Figures

ENGINE CONTROL

BACKGROUND OF THE INVENTION

1. Field of the Invention

This invention pertains to the art of speed control of an internal combustion engine which is desired to operate at at least two separate speeds, and in which loss of oil pressure control is also desired.

While the invention may be employed in connection with engines in various environments, emphasis herein will be given to its usefulness in connection with a transport refrigeration unit such as are typically used on truck trailers and other containers for goods which require either heating or cooling or both.

2. Description of the Prior Art

The use of internal combustion engines which operate continuously at one speed, and then shift to another speed in accordance with the requirements of refrigeration or heating are well known. One arrangement for obtaining different speeds in connection with a throttle lever on an engine is disclosed in U.S. Pat. No. 4,117,740. In the common contemporary commercial arrangements the speed control lever for the engine is actuated by an electrically powered solenoid in accordance with operating conditions of the refrigeration system. Such solenoids are, in a sense, relatively large in that they require 60–70 watts continuously and weigh more than 6 pounds. An arrangement which eliminates these relatively large, and fairly costly, electric actuators in favor of much smaller control solenoids is desirable. One aim of my invention is to accomplish this.

The engines for typical transport refrigeration systems may or may not have a loss of engine oil pressure control arrangement. One typical loss of oil pressure control arrangement uses an oil pressure sensitive switch and a thermal time delay. The time delay arrangement is to prevent a nuisance shutdown, such as from a momentary or intermittent loss of oil pressure, and may, for example, comprise a solder pot with a heater. With such an arrangement, at normal ambient temperature conditions, the loss of oil pressure will result in a safety shutdown in about 45 seconds after the condition is detected. While this is a relatively long period, it does not necessarily result in damage to the engine since the pressure sensitive switch operates at some minimum pressure such as 15 psi. In some cases this feature causes undesired shutdown or requires engine speed be maintained higher than the preferred minimum speed. A more significant disadvantage of this particular arrangement is that since it requires heating of the solder or other thermally sensitive element to permit the safety shutdown to occur, at low ambient temperature such as below 0° F., the safety shutdown arrangement may not work at all, even with a total loss of oil pressure. It is another aim of my invention to avoid these disadvantages, and more specifically to build a loss of oil pressure control into the speed control and in an arrangement in which continued engine operation can occur with a moderate, acceptable loss of oil pressure, and an engine shutdown will occur upon further degradation of the oil pressure.

SUMMARY OF THE INVENTION

In accordance with the invention, a pressurized fluid source, such as the oil pressure system of an engine, is used to provide the motive force for operating the speed control. With the oil pressure providing the motive force, a loss of oil pressure will accordingly result in reduction in speed and a shutdown if the oil pressure drops too low.

I have provided an arrangement to accomplish this in which the speed control and loss of oil pressure control includes an engine on-off control cylinder having a piston therein with the cylinder being connected to receive the pressurized oil and to return the oil to a return line through an on-off solenoid valve when the valve is open, and a speed cylinder with a speed piston therein, the speed cylinder being connected to the shutdown cylinder through conduit means including a speed solenoid valve therein, the speed piston being connected to the speed control means of the engine, the shutdown piston having one position when oil flows to the return line with the on-off valve open and an opposite position when the on-off valve is closed and the speed valve is closed, the speed piston having one position when the shutdown piston is in its one position, and a second position when the shutdown piston is in the opposite position and the speed solenoid valve is closed, and the third further position when oil is introduced to the speed solenoid with the speed solenoid valve open, the first position of the speed piston holding the speed control means for the engine in a position corresponding to the engine being off, and the second position holding the control means in a position corresponding to a low engine speed position and the third position holding the control in a position corresponding to a high engine speed position, the speed piston being moved from its first to its second position by the on-off piston movement from its one to its opposite position upon starting the engine, and the speed piston moving to its third position upon subsequent opening of the speed solenoid valve to pressurize the space in the speed cylinder and thereby moving the speed piston and the throttle to a higher speed.

The basic operation is to pressurize the on-off cylinder first upon cranking the engine by closing the solenoid valve in the return line, the movement of the on-off piston mechanically driving the speed piston to the low speed position. Then upon a call for higher speed, the speed solenoid valve is opened to admit the pressurized oil into the speed cylinder to hydraulically drive the speed piston to a high speed position. Since it is the pressure of the oil which is providing the motive force for the speed control, upon a predetermined drop in oil pressure the speed piston will be moved to a low speed position and correspondingly the engine speed will drop to low speed, and upon a further predetermined loss in oil pressure the on-off piston will be moved to the off position and the engine operation will be stopped.

DESCRIPTION OF A PREFERRED EMBODIMENT

Figure 1:
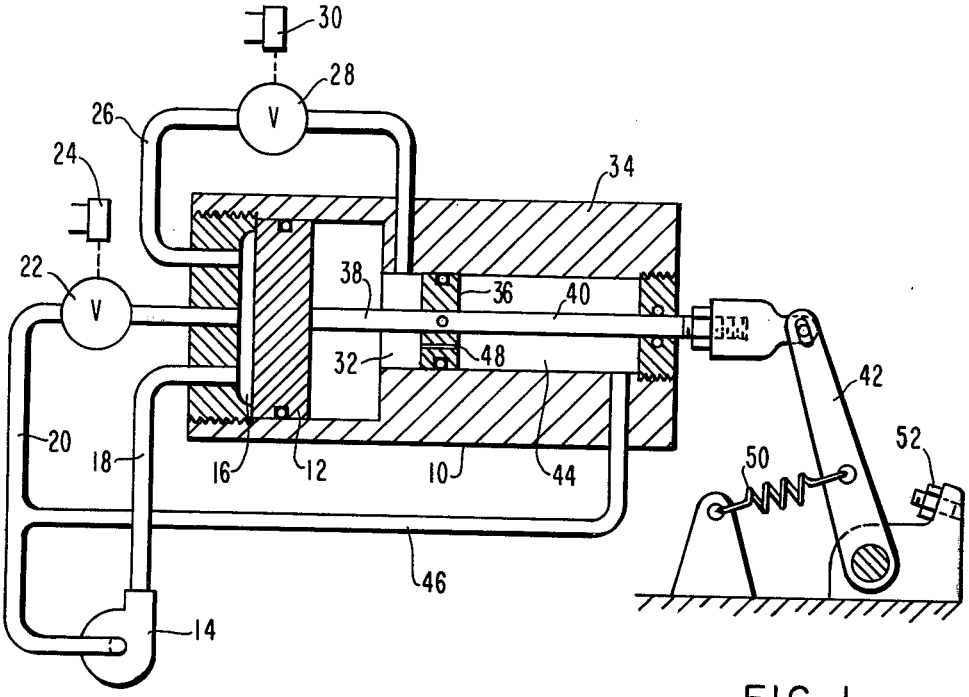
FIG. 1 is a partly diagrammatic, partly sectional view of an arrangement according to the invention in which the device is shown in a first speed control position.

The invention will be explained in connection with an engine for a refrigeration transport system. As such, the system may have either a diesel engine or a gasoline engine for powering it, so that the speed control lever may comprise either a speed and governor control lever as on a diesel, or a throttle and governor as on a gasoline engine.

The arrangement includes a first cylinder 10 provided with a first piston 12 therein, this cylinder being characterized as an on-off or shutdown cylinder. In the present example the engine is provided with an oil pump 14 which is adapted not only to provide lubrication for the engine but also as a source of pressurized oil for on-off and speed control. The space 16 in the cylinder 10 to the left of the head of the piston 12 is connected to receive pressurized oil from the pump 14 through the line 18 and to return the oil to return line 20 through the valve 22 in the line when it is opened by virtue of actuation of the solenoid 24.

An additional outlet from the space 16 in the on-off cylinder 10 comprises conduit 26 having valve 28 therein, and being herein characterized as the speed valve. The speed valve is controlled by solenoid 30 which operates in a way such that when higher speed is desired, the solenoid functions so that valve 28 will open. The conduit 26 continues from the valve to the space 32 in the speed cylinder 34, the space 32 being to the left of the head of speed piston 36 in the cylinder.

Figure 2:
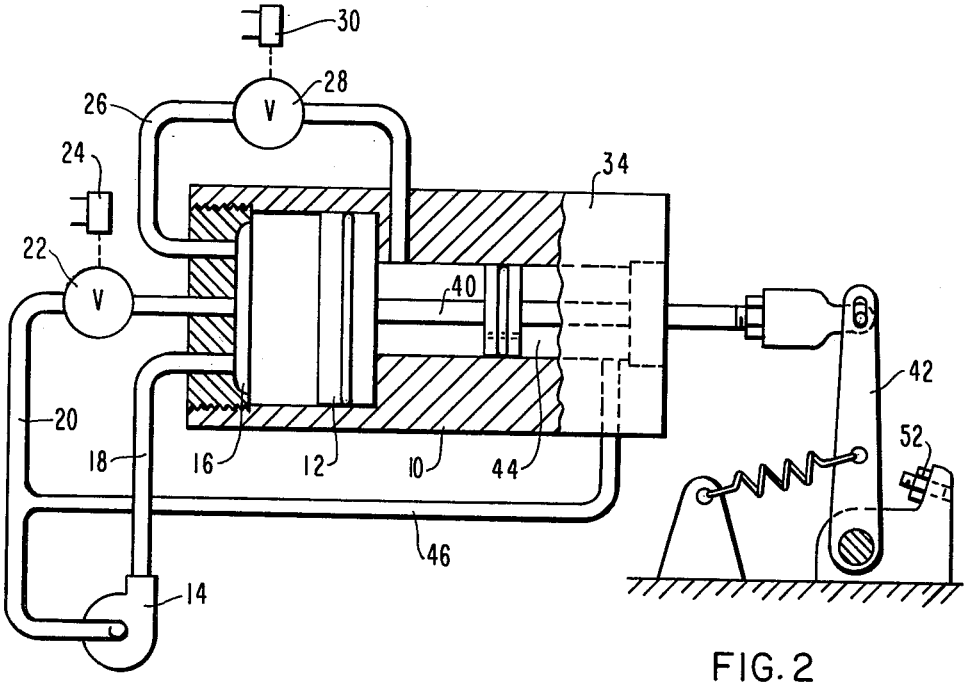
FIG. 2 is a view similar to FIG. 1 showing the device in a low speed position.

A rod 38 extends to the left from the head of the speed piston 36 and function to couple the on-off piston 12 to movement of the speed piston 36 when the on-off piston initially moves to the right upon start-up, to correspondingly drive the speed piston from its first position illustrated in FIG. 1, to the low speed second position as shown in FIG. 2. The speed piston is also coupled by rod 40 to the end of a speed control lever 42 so that movement of the lever corresponds to the positioning of the speed piston. The space 44 in the speed cylinder to the right of the speed piston is connected back to the fluid return line 20 through line 46. The speed piston is provided with means to permit controlled leakage from the space 42 to the space 44, such means being illustrated herein as a small leak bore 48 which permits the oil to leak through at a rate which is relatively restricted as compared to the rate at which oil can enter the space 32 upon initial opening of the valve 28. The speed piston is biased to the left against the rush of oil by any convenient means, either directly, or through such means as the biasing means 50 provided for the speed control lever.

OPERATION

As noted before, the pistons are shown in FIG. 1 in their first positions corresponding to the engine being off. With the engine off, the valve 22 in the return line is open. When the engine is to be started and the control key is switched to "on", this energizes the solenoid which closes the on-off valve 22. The speed valve 28 is also closed at this time. Upon cranking, the oil pressure pump 14 passes oil through line 18 into the space 16 which begins to force the on-off piston 12 to the right and correspondingly pushes speed piston 36 toward the right also and advances the speed control lever 42 from its illustrated position in FIG. 1 toward its illustrated position in FIG. 2. The on-off piston has a significantly larger head area than the back of the speed piston 36 in order to obtain adequate force when the oil pressure is relatively low during the cranking operation.

Figure 3:
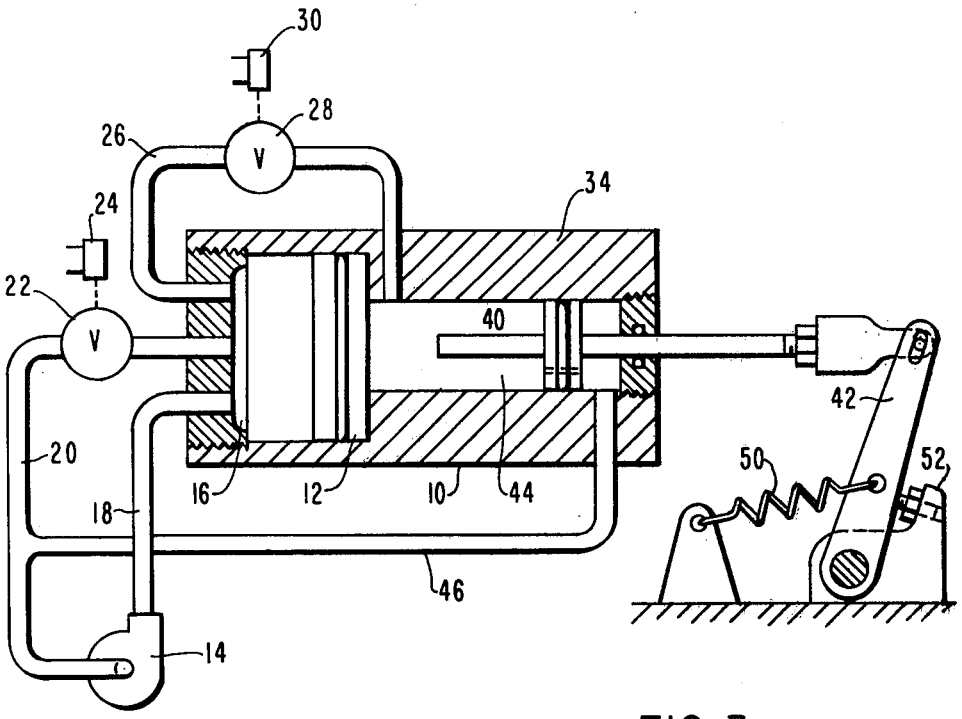
FIG. 3 is a view similar to FIGS. 1 and 2 showing the device in a high speed position.

When the engine starts, the piston 12 quickly moves to its second position as shown in FIG. 2, pushing the speed piston to its second position and accordingly establishing the speed control lever at the low speed position. When the refrigerant system calls for high speed engine operation, closure of the appropriate switch in the system energizes solenoid 30 which causes speed valve 28 to open. The pressurized oil now flows from the space 16 through line 26 and the valve 28 to the space 32. This results in speed piston 36 being displaced to the right and pushes the speed control lever 42 to the high speed position where the lever contacts the adjustable stop 52. The position of the parts in high speed operation is shown in FIG. 3, it being noted that the on-off piston 12 is subject to take any position in its cylinder since the pressures on opposite sides of it are basically the same with possible intermittent fluctuations. If the system demand calls for lower speed engine operation thereafter, the speed valve 28 will be closed through deenergization of the solenoid 30 and the speed control lever will pivot back toward the low speed position as the fluid leaks through the speed piston 36 and is returned to the engine oil sump.

If during operation there is a drop in the oil pressure to a predetermined level, the pressure would be inadequate to maintain the speed piston in its high speed third position and the engine will drop to low speed operation through movement of the speed piston to the left. However, the pressure on the larger area piston 12 may be adequate to maintain it in its second position which would stop further retreat of the speed piston. If there should be a further drop in oil pressure to a very low value making stopping of the engine desirable, the low pressure permits the on-off piston 12 and the speed piston 36 to both move to their first (off) position. This stops engine operation.

Since the speed control and the loss of oil pressure control are both subject to the oil pressure condition, in the arrangement according to the invention the engine can be very quickly stopped, as in 5 to 10 seconds, upon a substantially complete loss of oil pressure. This is in contrast to the noted prior art solder pot and heater arrangement which can typically take more than 45 seconds, depending on ambient temperature.

Since the solenoids 24 and 30 function as pilot solenoids, with the motive force being derived from the oil pressure, they can be relatively small, require 3 to 4 watts and accordingly inexpensive as contrasted to the relatively large solenoid of, say 60 watts required if the speed control lever is to be directly controlled by the solenoid.

The arrangement also permits the use of a relatively large oil supply line 18 which is beneficial in connection with start-up in relatively cold temperatures when the oil is relatively viscous.

What is claimed is:

1. A speed control arrangement for an internal combustion engine having means providing a source of fluid pressure, comprising:

a first cylinder having a first piston and a first space on one side of said piston connected to receive fluid under pressure and connected to discharge fluid into a fluid return line, said fluid return line including a first valve which, when closed, prevents fluid return therethrough to thereby cause the pressure in said first space to rise and move said first piston from a first position, corresponding to said engine being off, to a second position;

a second cylinder having a second piston and a second space on one side of said second piston connected through a conduit to said first space in said first cylinder, said conduit including a second valve which, when closed, prevents flow therethrough and, when open, permits flow from said first space to cause the fluid pressure in said second space to rise and thereby cause said second piston to move from a second position corresponding to said engine operating at a reduced speed to a third position corresponding to said engine operating at a higher speed;

means linking said second piston to the speed control means of said engine for control of said speed control means in accordance with positioning of said second position;

means causing said first piston to move said second piston from a first position corresponding to said engine being off to said second position when said first piston moves from said first to said second position upon engine start-up;

means biasing said second piston toward said first position;

means for returning fluid from said second cylinder to said return line at a rate restricted relative to the rate that said fluid is capable of entering said second space through said conduit; and said first solenoid valve being operated to a closed position upon engine start-up to pressurize said first space to cause reduced speed operation through movement of said first piston to said second position and consequent movement of said second piston to said second position, and said second valve being opened upon a call for a higher speed to thereby pressurize said second space and move said second piston to said third position to further advance said throttle for said higher speed.

2. An arrangement according to claim 1 wherein:

said source of fluid pressure comprises pressurized oil for lubrication of said engine.

3. An arrangement according to claim 2 wherein:

said first piston has a head area significantly larger than that of said second piston to obtain adequate force to move said first piston during cranking of said engine.

4. An arrangement according to claim 2 including:

electric solenoid means for operating said first and second valves.

5. A speed control and loss of oil pressure control arrangement for an internal combustion engine having a pressurized oil system, comprising:

an on-off, shutdown cylinder with a piston therein, said cylinder being connected to receive said pressurized oil, and to return said oil to a return line through an on-off solenoid valve when said valve is open;

a speed cylinder with a speed piston therein, said speed cylinder being connected to said shutdown cylinder through conduit means including a speed solenoid valve therein;

means connecting said speed piston to the speed control means of said engine for regulating said control means in accordance with positioning of said speed piston;

said shutdown piston having one position when oil flows to said return line with said on-off valve open, and an opposite position with said on-off valve and said speed value closed;

said speed piston having one position when said shutdown piston is in its said one position, and a second position when said shutdown piston is in said opposite position and said speed solenoid valve, and a third, further position when said oil is introduced to said speed cylinder with said speed solenoid valve open;

said speed piston first position holding said control means in a position corresponding to said engine being off, said speed piston second position holding said control means in a position corresponding to a low engine speed position, and said speed piston third position holding said control means in a position corresponding to a high engine speed position;

means for driving said speed piston to said second position by said shutdown piston upon movement of said shutdown piston from its one to its opposite position;

means for biasing said speed piston to said first position; and means for returning oil to said return line from said speed cylinder at a controlled leakage rate.

6. A speed control and loss of oil pressure control arrangement for an internal combustion engine having a pressurized oil system, comprising:

first and second axially aligned cylinders with a piston in each, said first piston operating from an engine off position to an engine low speed position upon receiving engine oil pressure in said first cylinder;

an oil return line connected to said first cylinder;

valve means for closing said oil return line upon initiating engine operation so as to pressurize said first cylinder and move said first piston to said engine low speed position;

means for pushing said second piston from an engine off position to an engine low speed position by said first piston in corresponding movement;

a conduit from said first cylinder to said second cylinder for the flow oil therethrough;

valve means preventing oil flow through said conduit under engine off and engine low speed conditions, and permitting oil flow under a demand for engine high speed to cause said second piston to move away from said first piston to an engine high speed position;

means operatively linking said second piston to engine speed control means;

means biasing said second piston toward an engine off position; and means for returning oil from said second cylinder at a control leakage rate to said oil return line.

* * * * *